United States Patent [19]

Timbrook

[11] Patent Number: 4,865,239

[45] Date of Patent: Sep. 12, 1989

[54] BABY BOTTLE HOLDER

[76] Inventor: Donald J. Timbrook, 3228 W. Mangold St. #11, Greenfield, Wis. 53221

[21] Appl. No.: 200,253

[22] Filed: May 31, 1988

[51] Int. Cl.[4] ..... A45F 5/00

[52] U.S. Cl. ..... 224/267; 224/220; 248/102

[58] Field of Search ..... 248/104, 106, 102, 231, 248/309.1, 316.8; 24/17 B, 3 A; 224/219, 220, 222, 148, 267; 446/227, 419, 421

[56] References Cited

U.S. PATENT DOCUMENTS

| | | | |
|---|---|---|---|
| 543,464 | 7/1895 | Brucksch | 182/8 |
| 2,165,625 | 7/1939 | Fessel | 224/219 |
| 2,539,698 | 1/1951 | Pearson | 248/104 |
| 2,686,029 | 8/1954 | Raymond | 248/201 |
| 3,273,766 | 9/1966 | Cosentino | 224/219 X |
| 3,550,824 | 12/1970 | Bohanski | 224/219 X |
| 4,061,256 | 12/1977 | Beer et al. | 224/219 |
| 4,184,528 | 1/1980 | Kobilan | 224/219 X |
| 4,489,867 | 12/1984 | Schwemberger | 224/219 X |
| 4,508,249 | 4/1985 | Kotchy | 224/219 |
| 4,733,808 | 3/1988 | Turner, Jr. et al. | 224/219 |

FOREIGN PATENT DOCUMENTS

| | | | |
|---|---|---|---|
| 0459782 | 4/1928 | Fed. Rep. of Germany | 224/219 |
| 3021110 | 12/1981 | Fed. Rep. of Germany | 248/104 |

*Primary Examiner*—Ramon O. Ramirez

*Attorney, Agent, or Firm*—Andrus, Sceales, Starke & Sawall

[57] ABSTRACT

A device for securing articles such as baby bottles or the like to the wrist of an infant includes a first length of tubing having at least one end removably secured to a "T" for forming a loop around an infant's wrist. A coupling is provided for joining the wirst loop to a second loop of material secured around an article such as a baby bottle whereby the article will not drop to the ground even if the infant releases its grip upon it.

7 Claims, 1 Drawing Sheet

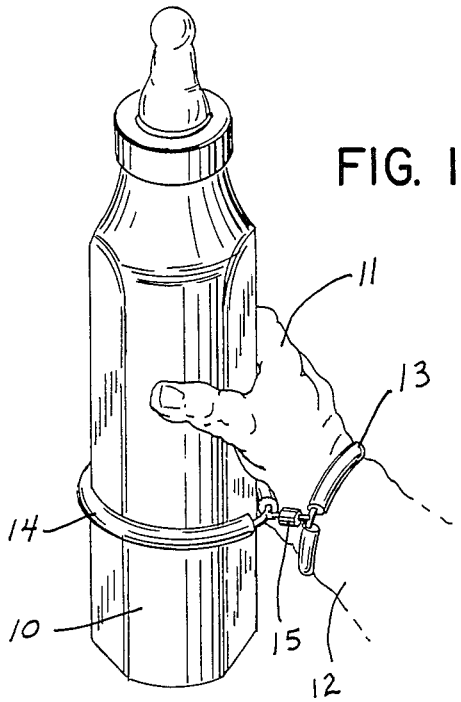
FIG. 1
FIG. 3
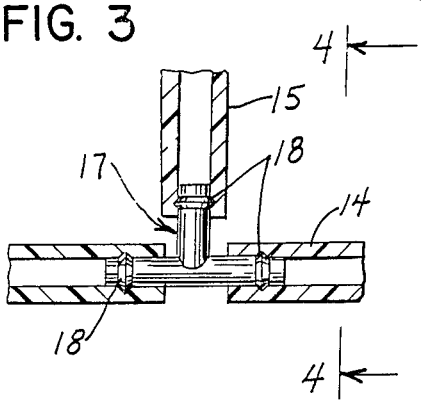
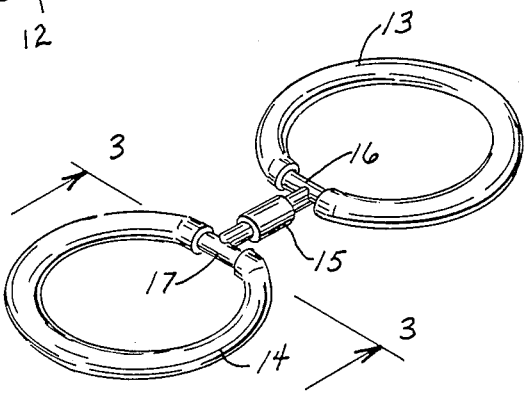
FIG. 2
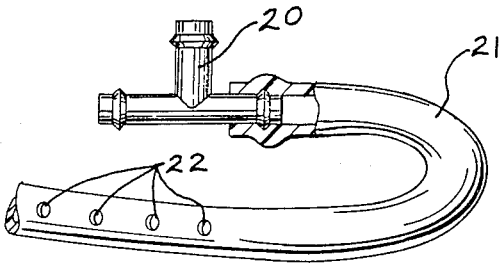
FIG. 5
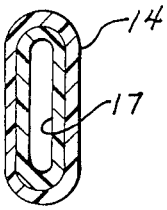
FIG. 4

BABY BOTTLE HOLDER

BACKGROUND OF THE INVENTION

I. Field of the Invention

The present invention relates to devices for securing a baby bottle to an infant's wrist to prevent the bottle from being dropped to the ground.

II. Description of the Prior Art

To applicant's knowledge there are no similar devices for accomplishing the purpose of the present invention. Accessory items have been observed where a bottle may be secured in remote locations such as by attachment to car seats, baby buggies, or the like with a nipple attached to tubing for the infant to receive nourishment. Such an approach obviously limits the mobility of the infant and also has a disadvantage in that the tubing may be difficult to clean between uses.

SUMMARY OF THE INVENTION

An object of the present invention is to provide a device for securing a baby bottle to an infant's wrist and prevent dropping of the bottle to the ground.

Another object of the invention is to provide a device for securing other articles such as food or pacifiers to an infant's wrist so that the articles may not be dropped.

The present invention comprises an adjustable loop of pliable soft material which may be secured around an infant's wrist. A connecter is provided which enables the loop around the baby's wrist to be coupled to a bottle or other article. The method of securing the article or baby bottle preferably includes a loop of similar flexible material which may also be adjusted to secure articles of differing shapes and sizes. Devices made according to the invention thus prevent an infant from dropping articles or bottles to the ground and thereby minimize the potential contact with infectious agents, dirt or the like.

DESCRIPTION OF THE DRAWINGS

FIG. 1 is a perspective view of a device according to the invention in place on a baby bottle and an infant's wrist;

FIG. 2 is a perspective view of an assembled device according to the invention independently of an infant or article to be secured;

FIG. 3 is a partial cross section taking along line 3—3 of FIG. 2;

FIG. 4 is a view taken along line 4—4 of FIG. 3; and,

FIG. 5 is a partial view of an alternate embodiment of the invention.

DESCRIPTION OF A PREFERRED EMBODIMENT

Referring to FIG. 1, a typical baby bottle 10 is shown being held in an infant's hand 11 with the infant's wrist 12 extending through a first or wrist loop 13. A second or article loop 14 is secured around the bottle 10 and also secured to wrist loop 13 by a connecting portion 15.

As is more clearly shown in FIGS. 2 and 3, the wrist loop 13 comprises a relatively short length of flexible tubular material with its two end portions coupled to extensions of a "T" 16. The leg of the "T" 16 extends into a short hollow coupling tube 15 and is preferably oriented to extend generally parallel to the wrist of the infant as shown in FIG. 1. A similar "T" 17 is provided to which the ends of the article loop 14 are secured and similarly connected to coupling tube 15. As illustrated in FIG. 3, the "T" 17 has protuberant portions 18 formed on each of its extensions to aid in securing the connector 15 and ends of the loop 14 in place. The "T" 16 may be similarly configured.

As shown in FIG. 4, the loops of tubing preferably have a hollow oval shape as would the cross-section of the "T" 17. The oval shape is particularly desirable for the wrist loop 13 so as to better distribute any forces generated by the weight of the bottle if the infant should let go of it. The wrist tubing is preferably formed from a soft pliable plastic material selected from a group that would be susceptible to sterilizing such as Tygon T 1000 tubing manufactured by Norton Performance Plastics. Given the wide variety of plastic and other material formulations commercially available, no attempt is made to enumerate acceptable types, except the preferred characteristics would include softness, elastically deformable and heat resistant.

Another version of the invention is illustrated in FIG. 5 where a "T" 20 is shown attached to one end of a hollow article holding tube 21. The opposite end of the tube 21 has a plurality of spaced apertures 22 extending through the tube walls with the apertures 22 each having a diameter sized to be secured over the opposite leg of the "T" 20. The provision of the radially extending apertures 22 thus enables the size of the loop formed by the tube 21 to be varied by selecting a specific aperture 22 for attachment to the "T" 20. This enables the loop to be formed to secure different sized articles such as baby crackers, cookies, a pacifier or other articles. The size of each loop may also be varied by cutting an end portion off to fit smaller wrists or articles. Disengagement of either loop is obtained by manually removing an end from the "T" section.

While a preferred version of the invention has thus been described, it will be apparent to those skilled in the art that many variations are possible without departing from the inventive concept. For example, while hollow plastic pliable tubing is preferred, other flexible materials could be utilized for forming the loops and securing the same such as fabrics or the like. In addition, one end or both ends of the loop materials may be permanently secured to the "T" or other connecting device to minimize the chances of the individual components from becoming loose and potentially swallowed by an infant or lost.

The wrist loop or the article loop, or both, could also be molded into performed shapes and sizes without the use of the same type of "T" or connecting device described. Additionally, the loops could be separated at a location other than the "T" and means provided to selectively open or close the loop at the separation point and an adjustable feature included. For example, a loop could consist of a hollow female portion and male portion adapted to fit within it with spaced protuberant portions for holding in a preselected adjusted position. If a fabric type loop was used, snaps or other devices could be utilized to provide adjustability.

While in practice two interconnected loops are preferred, those skilled in the art will appreciate that the wrist loop could be interconnected directly to a bottle or other article without utilizing the article loop. For example the connecting tube 15 could be directly affixed to a suitable coupling formed in a baby bottle for that purpose. Accordingly, the scope of the invention is not to be limited by the foregoing description of the preferred embodiment, but is to be taken solely from an interpretation of the claims which follow.

I claim:

1. A device for releasably securing a bottle to the wrist of an infant comprising:

attachment means for releasably securing said device to the bottle, loop means for releasably securing said device to the wrist of the infant, and linkage means comprising a length of semi-rigid material for connecting said attachment means to said loop means, said linkage means having a length such that when said loop means is secured to the wrist of the infant the bottle is maintained substantially adjacent the plam of the hand of the infant so that if the bottle is released by the infant the bottle is maintained by said linkage means substantially adjacent the palm of the hand of the infant so that the bottle may be readily regripped by the infant.

2. The device defined in claim 1 wherein said linkage means comprises a flexible tubular material.

3. The device defined in claim 1 wherein said attachment means comprises a substantially circular member of flexible material dimensioned to be slid over the body of the bottle and frictionally engage the body of the bottle to maintain its position on the bottle.

4. The device defined in claim 1 wherein said loop means comprises a substantially circular member of flexible material dimensioned to be slid over the hand of the infant.

5. The device defined in claim 1 wherein said attachment means is disposed in a first plane and said loop means is disposed in a second plane substantially perpendicular to said first so that the bottle is maintained in a position to be gripped by the infant.

6. A device for releasably securing a bottle to the wrist of an infant comprising:

attachment means for releasably securing said device to the bottle, said attachment means comprising a substantially circular member of flexible material dimensioned to be slid over the body of the bottle and frictionally engage the body of the bottle to maintain its position on the bottle, loop means for releasably securing said device to the wrist of the infant, said loop means comprising a substantially circular member of flexible material dimensioned to be slid over the hand of the infant, linkage means for connecting said attachment means to said loop means, said linkage means having a length such that when said loop means is secured to the wrist of the infant the bottle is maintained substantially adjacent the palm of the hand of the infant and said linkage means comprised of a length of semi-rigid material so that if the bottle is released by the infant the bottle is maintained by said linkage means substantially adjacent the palm of the hand of the infant so that the bottle may be readily regripped by the infant.

7. A device for releasably securing a bottle to the wrist of an infant comprising:

attachment means for releasably securing said device to the bottle, said attachment means comprising a substantially circular member of flexible material dimensioned to be slid over the body of the bottle and frictionally engage the body of the bottle to maintain its position on the bottle, loop means for releasably securing said device to the wrist of the infant, said loop means comprising a substantially circular member of flexible material dimensioned to be slid over the hand of the infant, linkage means for connecting said attachment means to said loop means, said linkage means having a length such that when said loop means is secured to the wrist of the infant the bottle is maintained substantially adjacent the palm of the hand of the infant and said linkage means comprised of a length of semi-rigid material so that if the bottle is released by the infant the bottle is maintained by said linkage means substantially adjacent the palm of the hand of the infant so that the botle may be readily regripped by the infant, and said attachment means being disposed in a first plane substantially perpendicular to the longitudinal axis of the bottle and substantially perpendicular to a second plane containing said loop means so that the bottle is maintained in a position to be gripped by the infant.

* * * * *